United States Patent [19]

James, Jr.

[11] 4,431,522

[45] Feb. 14, 1984

[54] CATALYTIC REFORMING PROCESS

[75] Inventor: Robert B. James, Jr., Northbrook, Ill.

[73] Assignee: UOP Inc., Des Plaines, Ill.

[21] Appl. No.: 473,417

[22] Filed: Mar. 9, 1983

[51] Int. Cl.[3] ..... C10G 35/04

[52] U.S. Cl. ..... 208/134

[58] Field of Search ..... 208/134

[56] References Cited

U.S. PATENT DOCUMENTS 3,566,845 3/1971 Barnes ..... 122/240

3,572,296 3/1971 Carson et al. ..... 122/275

4,110,197 8/1978 Herning et al. ..... 208/64

*Primary Examiner*—Curtis R. Davis

*Attorney, Agent, or Firm*—James R. Hoatson, Jr.; John F. Spears, Jr.; William H. Page, II

[57] ABSTRACT

A catalytic reforming process is disclosed wherein the reboiler heat requirements of the stabilizer column are supplied by means of indirect heat exchange with hot combustion gases in the reforming reactants fired heater convection heating section. Heat in excess of the reboiler requirements is passed to the stabilizer column with control being effected by removal of excess heat from the column.

13 Claims, 1 Drawing Figure

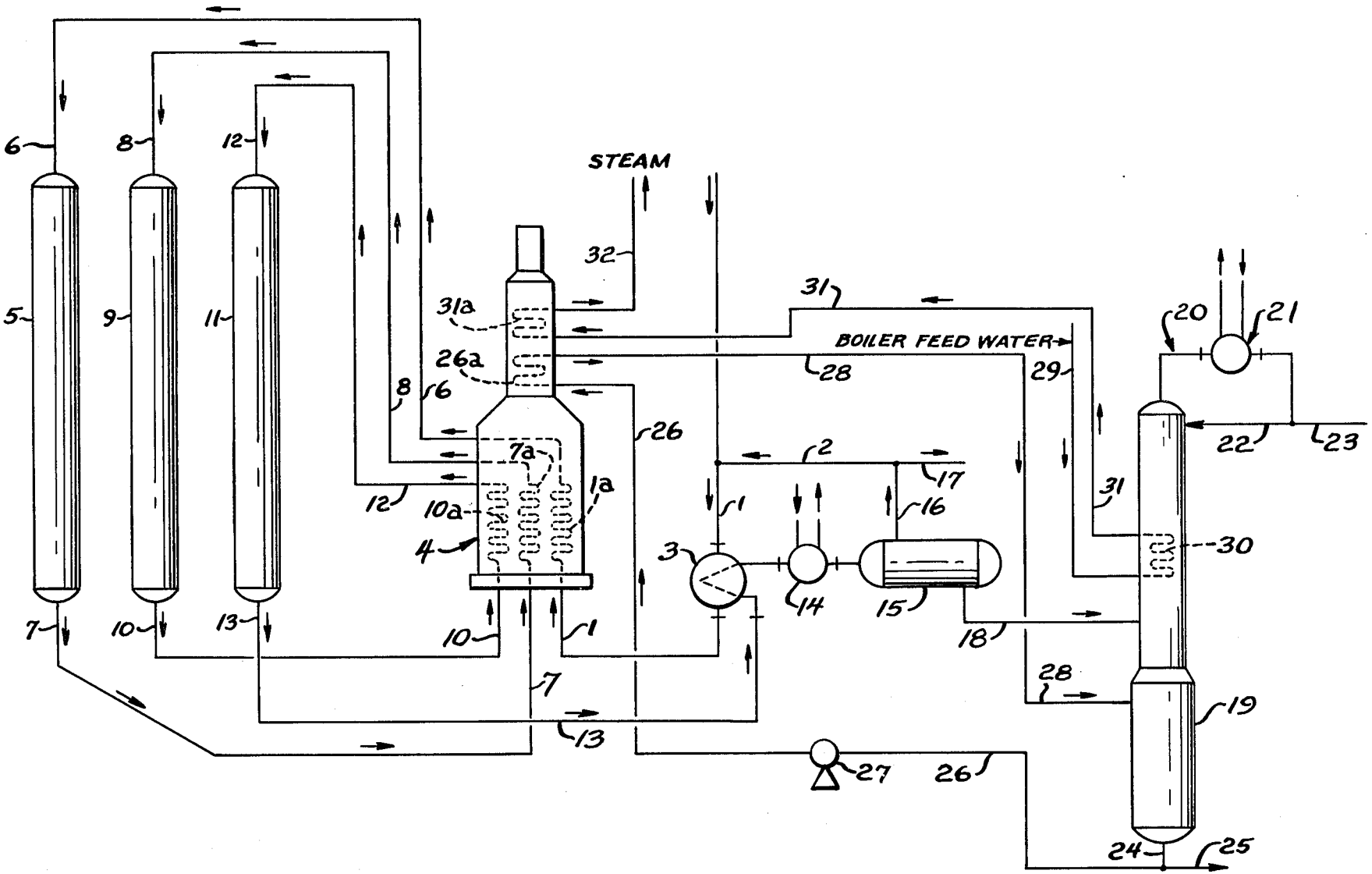
BOILER FEED WATER
STEAM

CATALYTIC REFORMING PROCESS

BACKGROUND OF THE INVENTION

The art of catalytic reforming is well known in the petroleum refining industry and does not require detailed description herein. In brief, catalytic reforming art is largely concerned with the treatment of hydrocarbonaceous feedstocks to improve their antiknock characteristics. Generally the hydrocarbonaceous feedstock comprises a petroleum gasoline fraction. Such a gasoline fraction may be a full boiling range fraction having an initial boiling point of from 50°–100° F. and an end boiling point of from 325°–425° F. More frequently, the gasoline fraction will have an initial boiling point of from 150°–250° F. and an end boiling point of from 350°–425° F., this higher boiling fraction being commonly referred to as naphtha. The reforming process is particularly applicable to the treatment of those straight-run gasolines comprising relatively large concentrations of naphthenic and substantially straight chain paraffinic hydrocarbons which are subject to aromatization through dehydrogenation and/or cyclization reactions. Various other concomitant reactions also occur, such as isomerization and hydrogen transfer, which are beneficial in upgrading the anti-knock properties of the selected gasoline fraction.

As will be hereinafter described in greater detail, in the typical catalytic reforming operation, feedstock, preferably a petroleum gasoline fraction, is first admixed with hydrogen. The feedstock and hydrogen mixture is thereafter heated to reaction temperature and then contacted with reforming catalyst. The reaction effluent is then separated to provide a vapor phase comprising hydrogen at least a portion of which is recycled for admixture with the feedstock and to provide a liquid phase which comprises a hydrocarbon reformate of improved anti-knock characteristics with volatile $C_1$ *to* $C_4$ components dissolved therein. The liquid phase is then stabilized to remove the volatile $C_1$ to $C_4$ components by fractionation, typically in a debutanizing fractionation column.

As noted above, various reactions take place during catalytic reforming. These reactions include dehydrogenation, cyclization, hydrocracking and isomerization. The net result is that catalytic reforming is highly endothermic. It is therefore common practice to effect catalytic reforming in more than one catalyst bed to allow reheating of the reactants in order to assure that they remain at reaction temperature. Thus the reaction effluent from a preceding catalyst bed may be reheated to reaction temperature before passage to a subsequent catalyst bed.

The highly endothermic nature of catalytic reforming necessitates great quantities of heat. Typically heat for catalytic reforming is provided by a fired heater. The hydrocarbon feedstock and hydrogen mixture, as well as the inter-catalyst bed effluents are passed through the radiant heating section of the fired heater where they are heated to reaction temperature. Since only a portion of the total heat liberated in the fired heater is actually absorbed, large quantities of fuel must be combusted in the fired heaters to assure sufficient heat for effecting the reforming reaction.

Because of the large consumption of fuel and the attendant costs, various methods have been employed to conserve fuel. One such method which has become common practice is recovering heat by preheating the feedstock and hydrogen mixture through indirect heat exchange with the reforming reaction effluent. Thus the feedstock and hydrogen mixture is first subjected to indirect heat exchange with the reforming reaction effluent and the preheated mixture is then passed to the fired heater where it is further heated to reaction temperature. Such a preheating step is disclosed in U.S. Pat. No. 4,110,197 and results in fuel savings because of the decrease in fired heater duty.

It should be noted that the reforming reactants fired heater is not the only fired heater commonly employed in the reforming process. As indicated above, it is common practice to subject unstabilized hydrocarbon reformate to a fractionation step following the separation thereof from the hydrogen-containing vapor phase. Typically the fractionation step is effected to remove hydrogen and $C_1$ to $C_4$ hydrocarbons from the unstabilized reformate. Such a fractionation step requires heat input into the fractionation column. Commonly, a source of such heat is a fired heater in which reformate, withdrawn from the column bottom, is heated to a desired temperature and reintroduced into the column. As with the fired heater used to heat the catalytic reforming reactants, the stabilizer column fired heater consumes significant amounts of fuel with only a percentage of the total heat liberated being absorbed by the reformate from the column bottom. It would, therefore, be advantageous to utilize a different source of heat other than the stabilizer column fired heater in order to reduce fuel consumption in the reforming process.

As noted previously, only a percentage of the heat liberated in the reforming reactants fired heater is absorbed by the hydrocarbon and hydrogen mixture in the radiant heating section of the heater. The balance of the heat liberated by combustion leaves the radiant section of the heater via high temperature combustion gases. Such hot combustion gases could serve as a source of heat for the stabilizer column by indirect heat exchange with reformate from the reboiler. However, traditional unit operations require that a small fired heater often referred to as a trim heater be employed for purposes of controlling the heat input to the column thereby negating part of the advantages to be derived from elimination of the higher duty stabilizer column fired heater.

It has now been determined that it is possible to achieve significant fuel savings by utilizing the reforming reactants fired heater as a source of heat for the reformate stabilizer column without having to utilize a second fired trim heater for control. It is therefore possible to utilize the catalytic reactants fired heater as a source of heat for reformate stabilization and fully realize the advantages to be derived by eliminating the stabilizer column fired heater. Instead of utilizing a small fired trim heater to control heat input into the column to that amount of heat necessary to achieve the desired degree of separation, it has been determined that the column may be operated by passing heat to the column in excess of that necessary to make the desired separation. In turn, all such excess heat is removed from the column thereby controlling its operation. By operating the stabilizer column so as to remove the excess heat, it is possible to utilize the reforming reactants fired heater to provide essentially all of the heat requirements of the stabilizer column without having to employ a fired trim heater.

Accordingly it is an object of this invention to achieve a significant reduction in the fuel consumption of a catalytic reforming process by providing essentially all of the heat requirements for the reformate stabilizer column by indirect heat exchange. More specifically, it is an object of this invention to provide essentially all of said heat requirements from indirect heat exchange with hot combustion gases from the radiant heating section of the reforming reactants fired heater.

In one of its broad aspects, the present invention embodies a process for catalytic reforming which comprises the steps of: (a) heating a mixture of a hydrocarbonaceous feedstock and hydrogen in a radiant heating section of a fired heater and thereafter contacting the heated mixture with a reforming catalyst at reforming conditions to produce a reaction effluent; (b) separating the reaction effluent into a hydrogen-rich vapor phase and a substantially liquid hydrocarbon phase; (c) introducing said liquid phase into a stabilizer column said column being maintained at fractionation conditions sufficient to provide an overhead fraction comprising hydrocarbons normally gaseous at standard temperature and pressure, and a bottom fraction comprising a hydrocarbon reformate; (d) recovering and reheating a first predetermined amount of the hydrocarbon reformate by indirect heat exchange with hot combustion gases in a convection heating section of the fired heater of step (a) and returning the reheated reformate to the stabilizer column to supply a quantity of heat to the column in excess of the reboiler heat requirements thereof; (e) removing excess heat from the column at a point above that at which the reheated reformate is returned to the column; and, (f) recovering a second portion of the hydrocarbon reformate as product.

In one embodiment of this invention, the excess heat is removed by subjecting stabilizer overhead vapor to indirect heat exchange in an overhead products condenser utilized for the condensation of the overhead vapor to column reflux. In a preferred embodiment, the excess heat is removed at a point below that at which reflux is introduced to the column.

In another embodiment, removal of the excess heat is effected through indirect heat exchange by use of a stabbed-in heat exchanger. In an alternative embodiment, however, removal of the excess heat is effected by withdrawing hot fluid from the column, subjecting the hot fluid to indirect heat exchange and returning the heat exchanged fluid to the column.

In a further embodiment, the quantity of heat supplied to the stabilizer column by the reheated reformate is from about 105% to about 140% of the reboiler heat requirements. Preferably the quantity of heat supplied by the reheated reformate is 125% of the reboiler heat requirements.

Other objects and embodiments will become apparent in the following more detailed specification.

The catalytic reforming of petroleum gasoline fractions is a vapor phase operation and is generally effected at conversion conditions which include catalyst bed temperatures in the range of from about 500° to about 1050° F., and preferably from about 600° to about 1000° F. Other reforming conditions include a pressure of from about 50 to about 1000 psig., preferably from about 75 to about 350 psig., and a liquid hourly space velocity (defined as liquid volume of fresh charge per volume of catalyst per hour) of from about 0.2 to about 10 $hr^{-1}$. The reforming reaction is carried out generally in the presence of sufficient hydrogen to provide a hydrogen/hydrocarbon mole ratio of from about 0.5:1.0 to about 10.0:1.0.

The catalytic reforming reaction is carried out at the aforementioned reforming conditions in a reaction zone comprising either a fixed or a moving catalyst bed. Usually, the reaction zone will comprise a plurality of catalyst beds, commonly referred to as stages, and the catalyst beds may be stacked and enclosed within a single reactor or the catalyst bed may be enclosed in a separate reactor in a side-by-side reactor arrangement. The reaction zones will generally comprise two to four catalyst beds in either the stacked or side-by-side configuration. In any case, as noted previously the endothermic nature of catalytic reforming requires the heating of both fresh charge stock and catalyst bed effluents before the introduction thereof to subsequent catalyst beds. The amount of catalyst used in each of the catalyst beds may be varied to compensate for the endothermic nature of the reforming reaction. For example, three catalyst beds are used to illustrate one preferred embodiment of this invention with about 12 vol. % of the catalyst being employed in the first bed and about 44 vol. % in each of the succeeding beds. Generally, the catalyst distribution will be such that the first bed will contain from about 10 to about 30 vol. %, the second from about 25 to about 45 vol. %, and the third from about 40 to about 60 vol. %. With respect to a four-catalyst bed system, suitable catalyst loadings would be from about 5 to about 15 vol. % in the first bed, from about 15 to about 25 vol. % in the second, from about 25 to about 35 vol. % in the third, and from about 35 to about 50 vol. % in the fourth. Unequal catalyst distribution, increasing in the serial direction of reactant stream flow, facilitates and enhances the distribution of the reactions as well as the overall heat of reaction.

Reforming catalytic composites known and described in the art are intended for use in the process encompassed by the present invention. As noted previously, catalytic reforming reactions are multifarious and include dehydrogenation of naphthenes to aromatics, the dehydrocyclization of paraffins to aromatics, the hydrocracking of long-chain paraffins into lower boiling, normally liquid material and, to a certain extent, the isomerization of paraffins. These reactions are generally effected through utilization of catalysts comprising one or more Group VIII noble metals (e.g. platinum, osmium, iridum, rhodium, ruthenium, palladium) combined with a halogen (e.g. chlorine and/or fluorine) and a porous carrier material such as alumina. Recent investigations have indicated that additional advantageous results are attainable and enjoyed through the cojoint use of a catalytic modifier; these are generally selected from the group of iron, cobalt, copper, nickel, gallium, zinc, germanium, tin, cadmium, rhenium, bismuth, vanadium, alkali and alkaline-earth metals, and mixtures thereof.

As noted earlier, the reforming operation further includes the separation of the hydrogen-rich vapor phase from the reaction effluent recovered from the reaction zone. In one embodiment of the invention, at least a portion of the hydrogen-rich vapor phase is recycled to provide at least part of the hydrocarbonaceous feedstock and hydrogen mixture passed to the radiant heating section of the fired heater. The separation of the hydrogen-rich vapor phase is usually effected at substantially the same pressure as employed in the reaction zone, allowing for pressure drop in the system, and at a temperature in the range of about 60° to about 120° F. to yield a vapor phase comprising relatively pure hydrogen. The principally liquid hydrocarbon phase is then further treated in a product stabilizer column for the recovery of the reformed product which is commonly referred to as reformate.

The reformate product stabilizer is operated at conditions selected to separate a normally gaseous hydrocarbon fraction generally comprising $C_4$- hydrocarbons or, if desired, $C_5$- hydrocarbons, and usually some residual hydrogen. Operating conditions typically include a pressure of from about 100 to about 300 psig., the pressure 9enerally being less than that at which the hydrogen-rich vapor phase is separated from reaction effluent to avoid the necessity of pumping the liquid hydrocarbon phase into the stabilizer column. Other operating conditions within the column include a bottoms temperature of from about 400° to about 500° F., and a top temperature of from about 110° to about 200° F. In the past a major portion of the heat requirement of the stabilizer column was generally provided by a separate fired heater. However, in contrast to past practice, the present invention utilizes the reforming reactants fired heater as essentially the only source of heat for the stabilizer column without use of a separate fired heater. In past practice, the reboiler heat requirements of the stabilizer column were met by careful control of the amount of heat passed to the column. In contradistinction, the present invention calls for heat in excess of the reboiler requirements to be passed to the stabilizer column. Removal of the excess heat from the column is then effected to assure the desired degree of separation of the normally gaseous hydrocarbon fraction from the reformate. Generally, the heat passed to the stabilizer column from the reforming reactants fired heater will comprise from about 105% to about 140% of the reboiler heat requirements. Excess heat which results from inadvertent operational variations such as fluctuations in ambient temperature or flow surges is generally less than 5% of the reboiler heat requirements and the term "excess heat" as used herein is not intended to include such transient factors.

The excess heat may be removed from the stabilizer column in any acceptable fashion. It is contemplated within the scope of the invention that excess heat be removed by subjecting stabilizer column overhead vapors to indirect heat exchange in the column overhead products condenser utilized for condensation of the overhead vapor to column reflux. Alternatively the excess heat may be removed at a point below that at which reflux is returned to the column. It is preferable that the excess heat be removed at a point close to the point of return of the reheated reformate. Because of the heat gradient within the column, such thermal energy would be at a relatively high temperature and, therefore, better suited for further use.

Removal of the excess heat can be effected by withdrawing hot fluid from the column, subjecting the hot fluid to indirect heat exchange and returning the heat exchanged fluid to the column. Instead of withdrawing the hot fluid from the column, removal of excess heat may be effected by use of a stabbed-in heat exchanger. When utilizing such a means, the hot column fluids are subjected to indirect heat exchange by means of a heat exchanger emplaced within the column obviating the necessity of withdrawing the hot fluid from the column.

Irrespective of the configuration of the heat removal means, the hot column fluid may be subjected to indirect heat exchange with any suitable fluid capable of absorbing the excess heat. For example the removal of excess heat may be effected through indirect heat exchange with boiler feed water. The boiler feed water is thereby preheated and may then be sent to a steam generator which, for example, may be located in the convection heating section of the reforming reactants fired heater. As an alternative to generating steam, the excess heat may be utilized to provide at least part of the reboiler heat requirements of a second fractionation column such as a deethanizer or a depropanizer. The hot column fluids may be subjected to indirect heat exchange with fluid from the reboiler of the second column thereby supplying at least a portion of the reboiler heat requirements thereof.

Fired heaters which may be employed in the present invention are those commonly used in the petroleum and chemical industries. They may be gas or oil fired. Fired heaters of the box or rectangular form may be used as well as the center-wall updraft type. Such heaters incorporate a radiant heat section comprising one or more banks of tubes, carrying the process fluid, along the different wall surfaces positioned in a manner to receive radiant heat from the burners. In the center-wall configuration, the radiant heat section comprises a row of burners which fire against each side of a longitudinal center partitioning wall and the resulting radiant heat is supplied to the process fluid tubes positioned along each sidewall. As an alternative to the traditional tube banks, it is also possible to employ inverted U-tube sections such as those disclosed in U.S. Pat. No. 3,566,845. A preferred process fluid tube configuration and heater design is set forth in U.S. Pat. No. 3,572,296 which discloses a low pressure drop heater particularly well suited for application in catalytic reforming operations.

Regardless of the configuration of the radiant heating section, not all the heat liberated by the firing of the fuel is absorbed by the process fluid in the radiant heating section. Rather, a substantial amount of heat leaves the radiant heating section with the combustion gases. It has become the practice to recover this heat from the hot combustion gases in the fired heater convection heating section. As with the radiant heat sections, convection heat sections may have various configurations. They may be designed to allow uniform flow of combustion gases through the convection heating section. Alternatively, nonuniform flow of combustion gases may be employed by varying the symmetry of the combustion gas flow path. Irrespective of its exact configuration, the convection section is arranged to allow the hot combustion gases to contact process fluid tubes, thereby effecting convective heat transfer between the gases and the tubes. In accordance with the present invention, hydrocarbon reformate will be passed to the process fluid tubes for heating in the convection heating section of the reforming reactants fired heater. The resulting heated hydrocarbon reformate is then returned to the stabilizer column to supply a quantity of heat to the column in excess of the reboiler heat requirements thereof. As noted previously, boiler feed water, preheated by indirect heat exchange with hot fluid from the stabilizer column, may be heated in the convection heating section and, accordingly, the preheated boiler feed water may also be passed to other process fluid tubes within the convection heating section. The configuration of the process fluid tubes within the convection heating section may be such that the hot combustion gases are subjected to indirect heat exchange with the boiler feed water before they are subjected to indirect heat exchange with the hydrocarbon reformate. Alternatively, the hot combustion gases may be subjected to indirect heat exchange with the boiler feed water after they are subjected to indirect heat exchange with the hydrocarbon reformate.

Of course the foregoing discussion on fired heaters is intended as a general explanation and is not meant to be an undue limitation on the scope of the present invention.

ILLUSTRATIVE EMBODIMENT

Further description of the process of this invention is presented with reference to the attached schematic drawing. The drawing and accompanying description represent a preferred illustrative embodiment of the invention. The data in the description are based on detailed engineering estimates. The following illustrative embodiment is not intended as an undue limitation on the generally broad scope of the invention as set out in the appended claims. Miscellaneous hardware, such as certain pumps, compressors, heat exchangers, valves, vessels, instrumentation and controls have been omitted or reduced in number as not essential to a clear understanding of the process, the utilization of such hardware being well within the purview of one skilled in the art.

Referring then to the drawing, a petroleum-derived naphtha fraction is charged to the process at a liquid hourly space velocity of about 3 $hr.^{-1}$ by way of line 1. It is then admixed with a hydrogen-rich gaseous stream, originating as hereinafter described, comprising about 71 mol. % hydrogen introduced from line 2 for a hydrogen to hydrocarbon ratio of about 4.5. The fresh feed is continued through heat exchanger 3 in line 1 wherein it is preheated to about 879° F. by indirect heat exchange with an effluent stream in line 13 recovered from reactor 11. The preheated reaction mixture is continued through line 1 to a gas-fired heater 4 and passed through a charge heating coil 1*a* in the radiant heating section thereof to provide a temperature of about 990° F. at the inlet to the catalyst bed of reactor 5. Reactor 5 is the first of three reactors comprising the catalytic reforming reaction zone, each of said reactors being maintained at reforming conditions including a temperature of about 990° F. and a pressure of about 325 psig. Said reforming conditions further include the utilization of a platinum-containing catalyst. The heated reaction mixture is transferred from said heater 4 to the initial reactor 5 via line 6.

Since the catalytic reforming reaction is endothermic in nature, the effluent stream from reactor 5 is directed through line 7 to another heating coil 7*a* in the radiant heating section of the fired heater 4 wherein said effluent stream is reheated to provide a temperature of about 990° F. at the inlet to the catalyst bed of reactor 9. The reheated reactor 5 effluent stream is withdrawn from the heater 4 and introduced into the second reactor 9 by way of line 8.

The effluent from reactor 9 is recovered through line 10 and passed to still another heating coil 1O*a* in the radiant heating section of the fired heater 4 to be reheated before introduction into the last reactor 11 of the series of reactors which comprise the catalytic reaction zone, the reheated effluent being withdrawn from said heater and introduced into said reactor 11 by way of line 12. The effluent stream from the last reactor 11 is withdrawn through line 13 at a temperature of about 970° F. and is passed through heat exchanger 3 wherein it is subjected to indirect heat exchange with the fresh feed as previously described. The reactor 11 effluent stream is then passed through cooler 14 and deposited into a separator 15 at a temperature of about 100° F. The separator 15 is maintained at conditions to separate a hydrogen-rich gaseous phase and a substantially liquid hydrocarbon phase, said conditions including a temperature of about 100° F. and a pressure of about 305 psig. The hydrogen-rich gaseous phase, comprising about 71 mol. % hydrogen, is recovered through an overhead line 16 with one portion being diverted through line 2 and admixed with the aforementioned naphtha fraction charged to the process through line 1. The balance of the gaseous phase from the separator 15 is discharged from the process through line 17.

The substantially liquid hydrocarbon phase is withdrawn from the separator 15 by way of line 18 and introduced into the stabilizer column 19 which is maintained at conditions of temperature and pressure to separate an overhead fraction comprising normally gaseous hydrocarbons at standard temperature and pressure, i.e. $C_4$-hydrocarbons. This overhead fraction is withdrawn from the stabilizer column through line 20 and then is cooled in condenser 21. Thereafter a portion of the overhead is returned to the column as reflux through line 22 with the balance of the overhead being withdrawn from the process through line 23. The reformate product is withdrawn as a bottoms fraction from the stabilizer column via line 24. A first predetermined amount of the reformate product stream, about 75% in this case, is passed through line 26 by pump means 27. Although a pump means is utilized in this instance, any suitable means for inducing and controlling flow may be used. The balance of the reformate product leaves the unit via line 25 as product. After leaving pump means 27, the reformate product is passed via line 26 to heating coil 26*a* in the convection section of the fired heater 4. In heating coil 26*a*, the reformate product stream is subjected to indirect heat exchange with hot combustion gases. In this instance, the predetermined amount of the reformate product is selected to provide about 125% of the reboiler heat requirements of the stabilizer column when subjected to indirect heat exchange in coil 26*a*. The reformate product stream, after heating in the convection heating section, is returned to the stabilizer column to provide the reboiler heat requirements thereof.

Boiler feed water enters the process via line 29 and is passed to heat exchange means 30 located in column 19. In heat exchange means 30, the boiler feed water is subjected to indirect heat exchange with hot column fluid thereby absorbing the excess heat from the column, in this instance the excess 25% of reboiler heat requirements passed to the column via the reformate product in line 28. The preheated boiler feed water is then passed through line 31 to heating coil 31*a* where it is subjected to indirect heat exchange with hot combustion gases which have previously been heat exchanged with the reformate product in heating coil 26*a*. Saturated steam then leaves coil 31*a* via line 32 for further use.

A comparison of the fired heater fuel consumption of the invention as described in the illustrative embodiment set out above with that of one prior art reforming process clearly exemplifies the advantages to be achieved by use of the invention. For purposes of the comparison, it is assumed that the prior art reforming process utilizes the reforming reactants fired heater convection heating section to provide 75% of the stabilizer column reboiler heat requirements and a separate fired trim heater to supply the remaining 25% of the reboiler heat requirements. Thus reformate product is withdrawn from the bottom of the stabilizer column, passed to the convection heating section of the reforming reactants fired heater, further heated in the stabilizer column fired trim heater, and introduced into the column to provide the reboiler heat requirements thereof. Because the amount of heat passed to the stabilizer column is carefully controlled to be equal to the reboiler heat requirements in the prior art process, it is unnecessary for the column to have a stabbed-in heat exchanger means to remove excess heat. It is also assumed that all other process variables in the prior art process are substantially the same as those in the illustrative embodiment above.

A prior art process as described above would have a reforming reactants fired heater duty of about $100\times10^6$ BTU/hr. Typically such a fired heater would have a heater efficiency of about 54% based on the lower heating value of the fuel. Accordingly the reforming reactants fired heater would necessarily need to fire about $185\times10^6$ BTU/hr. to achieve a $100\times10^6$ BTU/hr. heater duty. Since $100\times10^6$ BTU/hr. are absorbed in the radiant heating section of the reforming reactants fired heater, about $85\times10^6$ BTU/hr. exit the radiant heating section with the hot combustion gases (assuming negligible radiation loss from the heater). The hot combustion gases pass to the convection heating section wherein 75% of the reboiler heat requirements of the stabilizer column are absorbed in the reformate product stream. In this instance, the stabilizer column reboiler heat requirements are about $28\times10^6$ BTU/hr. Accordingly about $21\times10^6$ BTU/hr. are absorbed by the reformate product stream in the convection heating section. The resulting heated reformate product is then passed to the stabilizer column fired trim heater wherein an additional $7\times10^6$ BTU/hr. or about 25% of the stabilizer column reboiler heat requirements are absorbed. Such a fired trim heater typically adds an efficiency of about 80% and therefore about $8.8\times10^6$ BTU/hr. of fuel must be fired in order for $7\times10^6$ BTU/hr. to be absorbed in the radiant heating section of the trim heater. Thus in order to meet the reboiler heat requirements of the stabilizer column, a total of $193.8\times10^6$ BTU/hr. of fuel must be fired in both fired heaters.

By comparison, in the invention as set forth in the illustrative embodiment, the reforming reactants fired heater duty is $100\times10^6$ BTU/hr. As in the prior art process then, $185\times10^6$ BTU/hr. of fuel must be fired in order to meet the reforming reactants fired heater duty. However, in contradistinction to the prior art process, the reformate product which is passed through the convection heating section of the reforming reactants fired heater absorbs $35\times10^6$ BTU/hr. (or 125% of the reboiler heat requirements of the stabilizer column). After leaving the convection heating section, the heated reformate product is reintroduced into the stabilizer column to provide the reboiler heat requirements thereof. The $7\times10^6$ BTU/hr. in excess of the reboiler heat requirements is extracted from the column by subjecting the hot column vapors to indirect heat exchange with boiler feed water. The boiler feed water is then passed to the convection heating section of the reforming reactants fired heater to generate steam. Thus by use of the invention, the reboiler heat requirements of the stabilizer column are met by firing only $185\times10^6$ BTU/hr. of fuel, a savings of about $8.3\times10^6$ BTU/hr. over the prior art process. Accordingly then it can be seen that substantial fuel savings can be achieved through controlling the stabilizer column by means of rejecting excess heat as opposed to controlling the amount of heat passed to the column.

I claim as my invention:

1. A catalytic reforming process comprising the steps of:

(a) heating a mixture of a hydrocarbonaceous feedstock and hydrogen in a radiant heating section of a fired heater and thereafter contacting the heated mixture with a reforming catalyst at reforming conditions to produce a reaction effluent;

(b) separating the reaction effluent into a hydrogen-rich vapor phase and a substantially liquid hydrocarbon phase;

(c) introducing said liquid phase into a stabilizer column, said column being maintained at fractionation conditions sufficient to provide an overhead fraction comprising hydrocarbons normally gaseous at standard temperature and pressure, and a bottom fraction comprising a hydrocarbon reformate;

(d) recovering and reheating a first predetermined amount of the hydrocarbon reformate by indirect heat exchange with hot combustion gases in a convection heating section of the fired heater of step (a) and returning the reheated reformate to the stabilizer column to supply a quantity of heat to the column in excess of the reboiler heat requirements thereof;

(e) removing excess heat from the column at a point above that at which the reheated reformate is returned to the column; and, (f) recovering a second portion of the hydrocarbon reformate as product.

2. The process of claim 1 wherein the excess heat is removed by subjecting stabilizer overhead vapor to indirect heat exchange in an overhead products condenser utilized for the condensation of the overhead vapor to column reflux.

3. The process of claim 1 wherein the excess heat is removed at a point below that at which reflux is introduced to the column.

4. The process of claim 3 wherein removal of the excess heat is effected through indirect heat exchange by use of a stabbedin heat exchanger.

5. The process of claim 3 wherein removal of the excess heat is effected by withdrawing hot fluid from the column, subjecting the hot fluid to indirect heat exchange and returning the heat exchanged fluid to the column.

6. The process of claim 1 wherein at least a portion of the hydrogen-rich vapor phase is recycled to provide at least part of the hydrocarbonaceous feedstock and hydrogen mixture passed to the radiant heating section of the fired heater.

7. The process of claim 1 wherein the quantity of heat supplied to the stabilizer column by the reheated reformate is about 105% to about 140% of the reboiler heat requirements.

8. The process of claim 7 wherein the quantity of heat supplied to the stabilizer column by the reheated reformate is 125% of the reboiler heat requirements.

9. The process of claim 1 wherein the removal of the excess heat is effected by indirect heat exchange with boiler feed water.

10. The process of claim 9 wherein the heat exchanged boiler feed water is passed to the convection section of the fired heater where it is subjected to indirect heat exchange with hot combustion gases.

11. The process of claim 10 wherein the hot combustion gases are subjected to indirect heat exchange with the boiler feed water before they are subjected to indirect heat exchange with the hydrocarbon reformate.

12. The process of claim 10 wherein the hot combustion gases are subjected to indirect heat exchange with the boiler feed water after they are subjected to indirect heat exchange with the hydrocarbon reformate.

13. The process of claim 1 wherein the excess heat removed from the column is utilized to provide at least part of the reboiler heat requirements of a second fractionation column.

* * * * *